United States Patent [19]

Cherveny

[11] Patent Number: 4,999,612

[45] Date of Patent: Mar. 12, 1991

[54] GRAVITY FED REMOTE MAIL DELIVERY INDICATOR

[76] Inventor: Albert G. Cherveny, 18655 Willow Ave., Country Club Hills, Ill. 60478

[21] Appl. No.: 541,376

[22] Filed: Jun. 21, 1990

[51] Int. Cl.[5] ..... G08B 13/14

[52] U.S. Cl. ..... 340/569; 250/222.1; 340/556

[58] Field of Search ..... 340/569, 556, 674; 250/222.1

[56] References Cited

U.S. PATENT DOCUMENTS

| | | | |
|---|---|---|---|
| 2,438,785 | 3/1948 | McKallick | 340/569 X |
| 2,465,935 | 3/1949 | Scalia | 340/569 |
| 2,469,558 | 5/1949 | Jaskala | 340/569 X |
| 2,835,887 | 5/1958 | Seeley | 340/569 |
| 2,945,219 | 8/1960 | Dunn | 340/569 |
| 2,968,804 | 1/1961 | Buffington | 340/569 |
| 3,008,132 | 11/1961 | Conigliaro | 340/569 |
| 3,008,133 | 11/1961 | Conigliaro | 340/569 |
| 3,009,139 | 11/1961 | Hill | 340/569 |
| 3,040,141 | 6/1962 | Whildin | 200/61.63 |
| 3,114,141 | 12/1963 | Gerace | 340/281 |
| 3,150,361 | 9/1964 | Conigliaro | 340/569 X |
| 3,171,116 | 2/1965 | Conigliaro | 340/569 |
| 3,222,665 | 12/1965 | Tracy | 340/281 |
| 3,611,333 | 10/1971 | Conigliaro | 340/224 |
| 3,909,819 | 9/1975 | Radford | 340/569 X |
| 4,101,877 | 7/1978 | Rush | 340/569 |
| 4,163,225 | 7/1979 | Engel | 340/569 |
| 4,287,514 | 9/1981 | Wartman | 340/569 |
| 4,314,102 | 2/1982 | Lowe | 179/2 A |
| 4,372,482 | 2/1983 | Clerigues | 232/36 |
| 4,499,372 | 2/1985 | Nakano | 340/674 X |
| 4,520,350 | 5/1985 | Huang | 340/569 |
| 4,633,236 | 12/1986 | Buhl | 340/569 |
| 4,651,135 | 3/1987 | Duhsime | 340/569 |
| 4,794,377 | 12/1988 | Benages | 340/569 |
| 4,868,543 | 9/1989 | Binkley | 340/569 |
| 4,872,210 | 10/1989 | Benages | 340/569 |

*Primary Examiner*—Glen R. Swann, III
*Assistant Examiner*—Thomas J. Mullen, Jr.

[57] ABSTRACT

A wired mail delivery indicator having a physical construction which forces any size of mail across a groove (20). Slope on the left vertical wall of mailbox (10), slope of panel (14), and force of gravity cause mail to block light beam. The light beam is generated by a photodiode emitter (22) and detected by a photo detector (24). Mailbox and electronic circuitry (26) contains photodiode emitter (22), photo detector (24), current limiting resistor (42), and current amplifier transistors (46 and 48). House end electronic circuitry (28) contains power transformer (32), diode rectifier (34), and current sensor (38, 40, and 36). House/mailbox connecting wire (18) carries power and mail delivery information with two wires.

1 Claim, 2 Drawing Sheets

GRAVITY FED REMOTE MAIL DELIVERY INDICATOR

BACKGROUND

1. Field of Invention

This invention relates to indicators, specifically to one which tells if mail has been deposited in a mailbox at a remote location.

2. Description of Prior Art

Heretofore, mail delivery indicators used mechanical switches and mechanisms to indicate the presence of mail in the box. Others, such as the device in U.S. Pat. No. 4,868,543 to Binkley (1989) required battery maintenance, used valuable radio spectrum, and used complex circuitry. Mailbox in U.S. Pat. No. 4,499,372 to Nakano (1985) employed complex electronic circuitry as above and used multiple emitter/detector pairs. Until now, mail delivery indicators known suffer from a number of disadvantages:

(a) Their design requires the periodic replacement of batteries in the mailbox.

(b) Complex electronic circuitry is required.

(c) Multiple emitter/detector pairs or complex sensor signal paths are used.

(d) Wired versions require more than a single pair of wires.

(e) Radio transmissions from the remote mailbox result in reduced privacy.

(f) Valuable radio spectrum is used for radio transmissions from the remote mailbox.

OBJECTS AND ADVANTAGES

Accordingly, several objects and advantages of my invention are:

(a) to eliminate the need for periodic replacement of batteries in the mailbox.

(b) to simplify the electronic circuitry required.

(c) to reduce the number of emitter/detector pairs and sensor signal paths to one.

(d) to reduce the number of wires needed in wired versions to one pair.

(e) to increase privacy of the system.

(f) to reduce the usage of valuable radio spectrum.

Further objects and advantages of my invention will become apparent from a consideration of the drawings and ensuing description of it.

DRAWING FIGURES

In the drawings, closely related figures have the same number but different alphabetic suffixes.

REFERENCE NUMBERAL IN DRAWINGS

Figure 1:
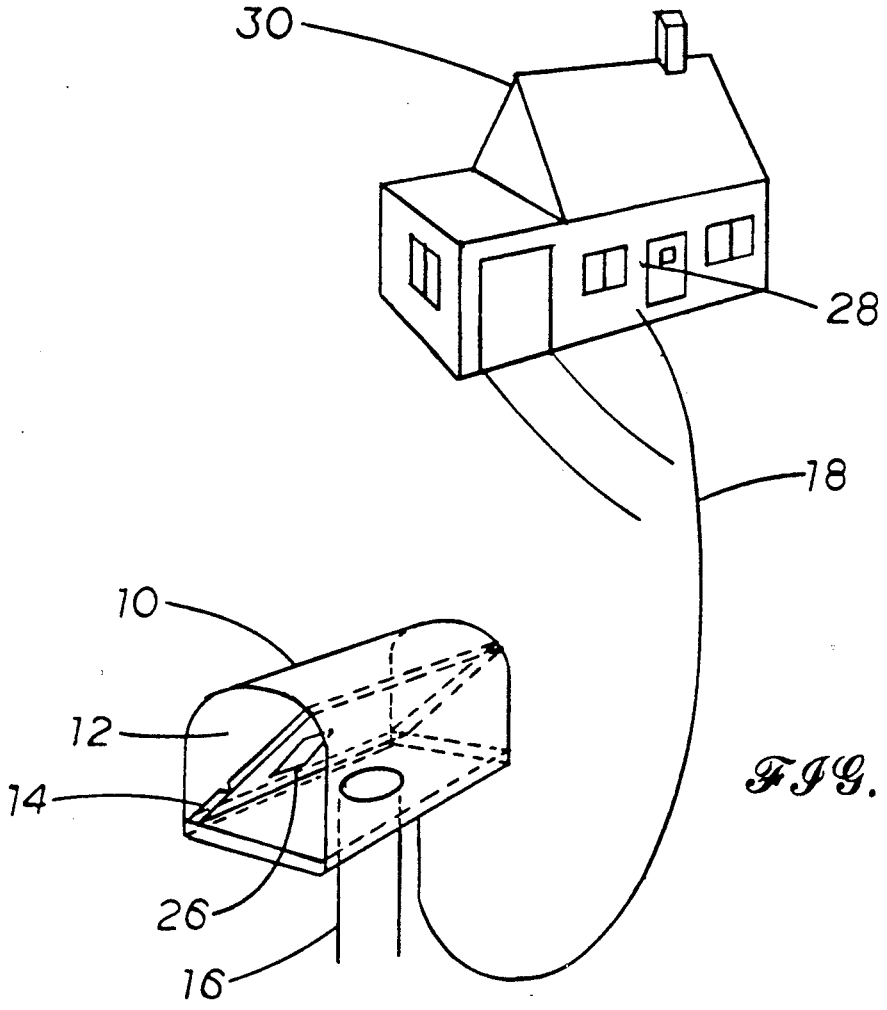
FIG. 1 illustrates the mailbox with associated mail delivery indicator.

10: mailbox
12: mail holding area
14: panel
16: support post
18: house/mailbox connecting wire
20: groove
22: photodiode emitter
24: photo detector

26 :mailbox end electronic circuitry
28: house end electronic circuitry
30: house
32: power transformer
34: diode D1
36: light emitting diode D3
38: resistor R1
40: diode D2
42: resistor R2
44: resistor R3
46: transistor Q1
48: transistor Q2
50: bypass resistor R4.

Figure 2:
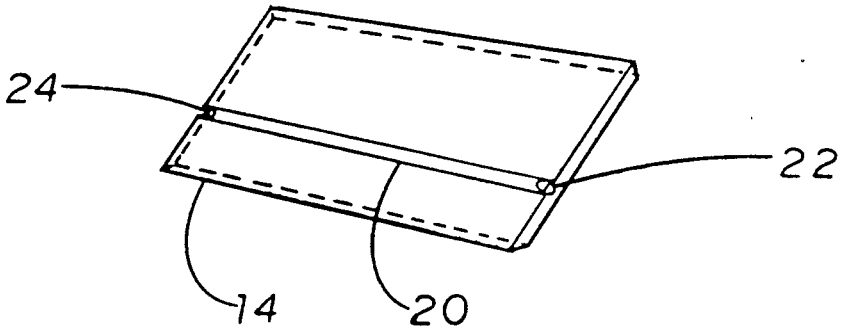
FIG. 2 is a detailed view of the panel with a single emitter/detector pair.

DESCRIPTION—FIGS. 1 to 3

FIG. 1 shows a perspective view of a version of my mail delivery indicator. A mailbox 10 is supported by a support post 16. In the backround is a house 30. In house 30 is a house end electronic circuitry 28. This circuitry is mounted at eye level within house 30. A house/mailbox connecting wire 18 runs between mailbox 10 and house 30. Wire 18 can be located above or below ground. Within mailbox 10 is a panel 14 which is positioned diagonally within mailbox 10. A mail holding area 12 is the area between panel 14 and the top of mailbox 10. The space between panel 14 and the bottom and right sides of mailbox 10 is an area for mailbox end electronic circuitry 26. This is where an electronic circuit associated with mailbox 10 is mounted.

FIG. 2 shows a detailed view of the panel assembly. A groove 20 runs along a path from the front to the rear of panel 14. Groove 20 is a furrow which is about 4 mm wide and 1.5 mm deep in panel 14. It is located about 76 mm from the lower end of panel 14. Panel 14 is about 466 mm from front to rear. It is about 200 mm from the low end to the high end. A photodiode emitter 22 and a photo detector 24 are located at opposite ends of panel 14. Emitter 22 and photo detector 24 connect by wires to electronic circuitry on the lower side of panel 14.

Figure 3A:
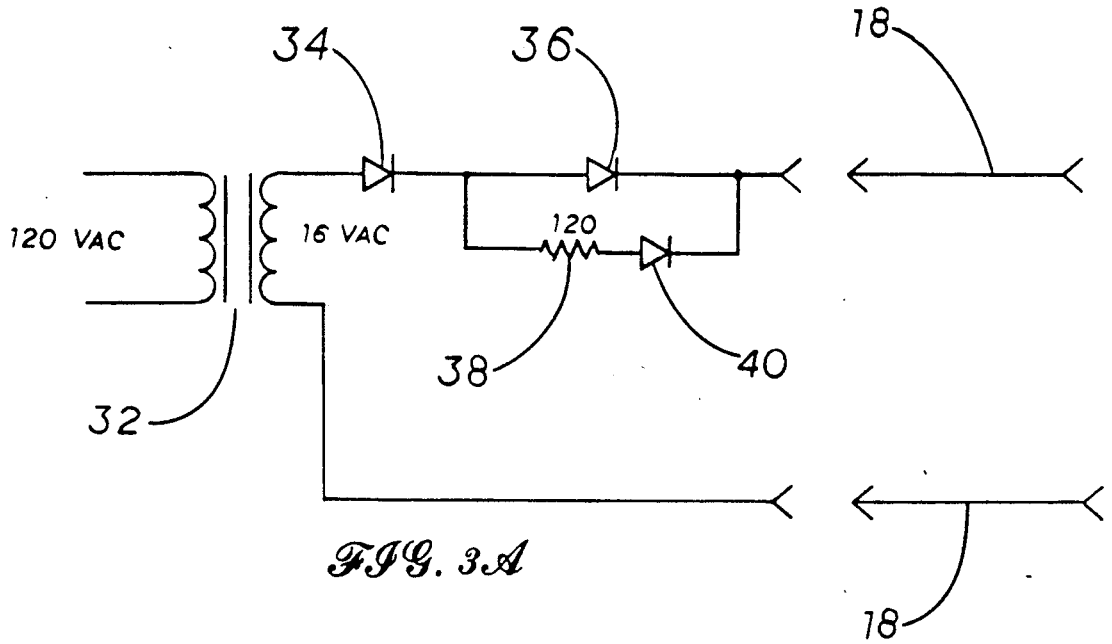
FIGS. 3A and 3B are schematics of the electronic circuit.

FIG. 3A is a detailed schematic of house end electronic circuitry 28. It consists of a power transformer 32, a diode D1 34, a diode D2 40, a light emitting diode D3 36, and a resistor R1 38. These parts are all mounted on a printed circuit board.

Figure 3B:
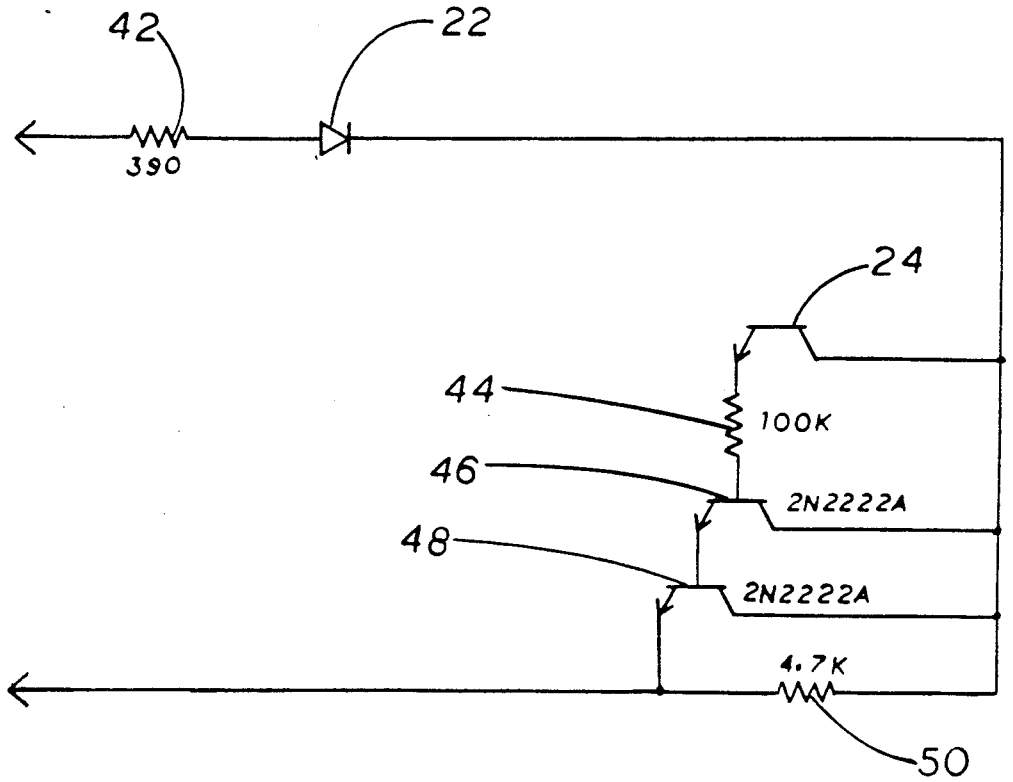

Likewise, FIG. 3B is a detailed schematic of a mailbox end electronic circuitry 26. It consists of a resistor R2 42, a photodiode emitter 22, a resistor R3 44, and a bypass resistor R4 50. It also contains detector 24, a transistor Q1 46, and a transistor Q2 48. These components are also mounted on a printed circuit board. Both circuitry 28 and circuitry 26 are attached by wire 18.

OPERATION—FIGS. 1 to 3

When any size of mail is deposited in the box, the light beam which follows the path of groove 20 is blocked. This reduces current in wire 18 to less than 10 mA. This occurs because emitter 22 and detector 24 are mounted so that the maximum light output and detection sensitivity are in the plane of the top surface of panel 14. Detector 24 does not sink current when it detects no infrared emission from emitter 22. As long as mail is in the box and the infrared beam is blocked somewhat less than 10 mA will flow in a series circuit thru D1 34, R1 38, D2 40, R2 42, emitter 22, and R4 50. Current will not flow thru D3 36 when the current in wire 18 is less than 10 mA. This is because the forward bias on D2 40 is about 0.7 V. Current will flow thru R1 38 and D2 40 until the total voltage across R1 38 and D2

40 reaches 1.9 V. A current sensor comprises D3 36, R1 38, and D2 40.

If no mail is contained in mailbox 10, the light beam path in groove 20 is not blocked and current flows thru detector 24. This current thru detector 24 is amplified by Q1 46 and Q2 48 to greater than 10 mA, turning on D3 36. An amplifying means comprises R3 44, Q1 46, and Q2 48. D3 36 is visible to the occupant of house 30. Whenever D3 36 is lit the occupant of house 30 knows that no mail is contained in mailbox 10.

Transformer 32 converts 120 VAC to 16 VAC. A voltage source comprises transformer 32. D1 34 is needed because of the low reverse voltage rating of D3 36 and emitter 22. R2 42 is needed to limit current thru emitter 22 if the specified 100 to 300 gains of Q1 46 and Q2 48 are near the high end. R3 44 limits current thru detector 24. Panel 14 and a slight inward tilt on the left wall of mailbox 10 work together to force any size of mail larger than 80 mm wide aross groove 20. If, for example, mail is inserted in a vertical plane near the left wall of mailbox 10, the slight tilt on the left wall will force the mail down across groove 20. If, on the other hand, mail is inserted in mailbox 10 above and to the right of groove 20, gravity will force the mail to slide down across groove 20. This system allows for the use of a single emitter 22/detector 24 pair. The seam between mailbox 10 and panel 14 must not have a gap, otherwise mail can get caught and held vertically in it.

SUMMARY, RAMIFICATIONS, AND SCOPE

Thus the reader will see that the gravity fed mail delivery indicator is a simple, economical, yet effective device with widespread potential appeal. Furthermore the mail delivery indicator has the additional advantages that it eliminates the need for periodic replacement of batteries in the mailbox;

it simplifies the electronic circuitry required;

it reduces the number of emitter/detector pairs and sensor signal paths to one;

it reduces the number of wires needed in wired versions to one pair;

it increases privacy of the system; and it reduces the usage of valuable radio spectrum.

While my above description contains many specifities, these should not be construed as limitations on the scope of the invention, but rather as an exemplification of one preferred embodiment therof. Many other variations are possible. For example, the overall shape of the mailbox can be changed. The area for mailbox end electronic circuitry can be reduced. The only constraints are for a design where gravity forces any size of mail into the light beam path while using a single emitter/detector pair.

An alternative version of the mailbox end circuit places the emitter and detector circuits in parallel instead of in series. Also, the emitter/detector pair used can have infrared or visible light wavelengths.

Accordingly, the scope of the invention should be determined not by the embodiments illustrated, but by the appended claims and their legal equivalents.

I claim:

1. A remote mail delivery indicator device, comprising:

(a) a photodiode emitter;

(b) a photo detector;

(c) an amplifying means;

(d) a voltage source;

(e) a current sensor;

(f) a house/mailbox connecting wire;

(g) a bypass resistor;

(h) a mailbox having front, rear, side and bottom walls;

(i) a panel supported by said side and bottom walls and extending between said front and rear walls of said mailbox, with a groove extending longitudinally along said panel of sufficient width and depth to accommodate a light beam from said photodiode emitter and with the lateral center of said groove located a distance from one side of said panel of less than about 80 millimeters;

(j) said panel being mounted in said mailbox with slope of approximately one with said groove on the top side of said panel and said one side positioned along said bottom wall of said mailbox;

(k) said side wall which is positioned adjacent said one side being tilted from vertical in the direction of the panel;

(l) said photodiode emitter and said photo detector being mounted at longitudinally opposite ends of said groove so that maximum emission and detection sensitivity occur in the plane of said top side of said panel;

(m) mailbox end electronic circuitry comprising said photodiode emitter, said photo detector, said amplifying means, and said bypass resistor;

(n) house end electronic circuitry comprising said voltage source and said current sensor; and (o) said house/mailbox connecting wire uniting said mailbox end electronic circuitry and said house end electronic circuitry.

* * * * *